US010233627B2

(12) United States Patent
Luettgen et al.

(10) Patent No.: US 10,233,627 B2
(45) **Date of Patent: *Mar. 19, 2019**

(54) RIMLESS TOILET

(71) Applicant: Kohler Co., Kohler, WI (US)

(72) Inventors: Michael J. Luettgen, Grafton, WI (US); William C. Kuru, Plymouth, WI (US); Sudip Mukerji, Cedarburg, WI (US); Douglas E. Bogard, Kohler, WI (US); Peter W. Swart, Oostburg, WI (US); Clayton C. Garrels, Sheboygan, WI (US); John F. Emmerling, Howards Grove, WI (US); Kari L. Jaeckels, Sheboygan Falls, WI (US); Michael D. Lindsay, Waldo, WI (US)

(73) Assignee: KOHLER CO., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/047,351

(22) Filed: Jul. 27, 2018

(65) Prior Publication Data

US 2018/0334790 A1 Nov. 22, 2018

Related U.S. Application Data

(63) Continuation of application No. 14/664,419, filed on Mar. 20, 2015, now Pat. No. 10,060,113.

(60) Provisional application No. 61/968,718, filed on Mar. 21, 2014.

(51) Int. Cl.

| | |
|---|---|
| ***E03D 11/02*** | (2006.01) |
| ***E03D 11/08*** | (2006.01) |
| ***E03D 9/00*** | (2006.01) |

(52) U.S. Cl.
CPC ..... *E03D 11/08* (2013.01); *E03D 9/00* (2013.01); *E03D 11/02* (2013.01); *E03D 2201/40* (2013.01)

(58) Field of Classification Search
CPC ..... E03D 11/08; E03D 11/06
USPC ..... 4/425, 420
See application file for complete search history.

(56) References Cited

U.S. PATENT DOCUMENTS

| | | | |
|---|---|---|---|
| 26,243 | A | 11/1859 | Boch, Sr. |
| 97,105 | A | 11/1869 | Moore |
| 166,209 | A | 8/1875 | Leland |
| 172,571 | A | 1/1876 | Leland |
| 172,572 | A | 1/1876 | Leland |

(Continued)

FOREIGN PATENT DOCUMENTS

| | | |
|---|---|---|
| CN | 101835945 | 9/2010 |
| CN | 202755424 | 2/2013 |

(Continued)

OTHER PUBLICATIONS

Chinese Office Action issued in corresponding CN Application No. 201580000385 dated Feb. 4, 2017.

(Continued)

*Primary Examiner* — Lauren Crane
(74) *Attorney, Agent, or Firm* — Foley & Lardner LLP

(57) ABSTRACT

A toilet includes a bowl and a vertically-elongated jet hole disposed within a portion of the bowl, near a top of the bowl between a rear of the bowl and a side of the bowl. The vertically-elongated jet hole is configured to direct flush water around an inner surface of the bowl to wash the inner surface of the bowl. The bowl does not include a rim that overhangs any portion of the bowl above the vertically-elongated jet hole.

20 Claims, 14 Drawing Sheets

(56) References Cited

U.S. PATENT DOCUMENTS

| | | | |
|---|---|---|---|
| 188,897 | A | 3/1877 | Harrison |
| 206,049 | A | 7/1878 | Smith |
| 220,688 | A | 10/1879 | Wilson |
| 233,470 | A | 10/1880 | Burke |
| 243,329 | A | 6/1881 | Trested |
| 266,309 | A | 10/1882 | Pike |
| 273,668 | A | 3/1883 | Connolly |
| 305,141 | A | 9/1884 | Brandeis |
| 310,370 | A | 1/1885 | Brady |
| 340,287 | A | 4/1886 | Clifford |
| 345,667 | A | 7/1886 | Buskirk |
| 476,011 | A | 5/1892 | Hamilton |
| 796,848 | A | 8/1905 | Leanhart |
| 1,107,094 | A | 8/1914 | Mitchell |
| 1,183,893 | A | 5/1916 | Mann |
| 1,308,301 | A | 7/1919 | Sakogawa |
| 1,928,717 | A | 10/1933 | Campus |
| 2,153,536 | A | 4/1939 | Groeniger |
| 2,154,240 | A | 4/1939 | Groeniger |
| 2,164,320 | A | 7/1939 | Groeniger |
| 3,046,569 | A | 7/1962 | Holberson |
| 3,334,358 | A | 8/1967 | McPherson |
| 3,538,518 | A | 11/1970 | Helke et al. |
| 3,860,973 | A | 1/1975 | Uyeda et al. |
| 4,075,718 | A | 2/1978 | Hargraves |
| 4,145,776 | A | 3/1979 | Crosby et al. |
| 4,155,129 | A | 5/1979 | Russell |
| 4,158,243 | A | 6/1979 | McCann |
| 4,217,668 | A | 8/1980 | Sargent et al. |
| 4,246,666 | A | 1/1981 | Stansbury, Jr. |
| 4,404,696 | A | 9/1983 | Heinze et al. |
| 4,475,887 | A | 10/1984 | Foster et al. |
| 4,581,779 | A | 4/1986 | Matsui et al. |
| 4,813,085 | A | 3/1989 | Strangfeld |
| 4,930,167 | A | 6/1990 | Ament |
| 5,073,994 | A | 12/1991 | Sargent et al. |
| 5,271,105 | A | 12/1993 | Tyler |
| 5,666,675 | A | 9/1997 | Ruegg |
| 5,715,544 | A | 2/1998 | Huffman et al. |
| 5,875,499 | A | 3/1999 | Hoffman et al. |
| 5,918,325 | A | 7/1999 | Arita et al. |
| 6,070,276 | A | 6/2000 | Yeung |
| 6,145,138 | A | 11/2000 | Nakamura et al. |
| 6,247,193 | B1 | 6/2001 | Riepl |
| 6,367,095 | B2 | 4/2002 | Hubatka |
| 6,397,405 | B1 | 6/2002 | Grech et al. |
| 6,415,457 | B2 | 7/2002 | Schmucki |
| 6,986,172 | B2 | 1/2006 | Hidetaka et al. |
| 7,263,727 | B1 | 9/2007 | Zhurin et al. |
| 7,640,604 | B2 | 1/2010 | Cummings |
| 7,661,153 | B2 | 2/2010 | Nakamura et al. |
| 7,827,628 | B2 | 11/2010 | Ichiki et al. |
| 8,151,379 | B2 | 4/2012 | Mueller et al. |
| 8,336,128 | B2 | 12/2012 | Murphy |
| 8,528,123 | B2 | 9/2013 | Hashem |
| 2003/0115664 | A1 | 6/2003 | Kosugi et al. |
| 2003/0140406 | A1 | 7/2003 | Miwa et al. |
| 2005/0000007 | A1 | 1/2005 | Cummings |
| 2005/0005348 | A1 | 1/2005 | Buchanan |
| 2005/0268391 | A1 | 12/2005 | Reichmuth et al. |
| 2006/0005310 | A1 | 1/2006 | Nakamura et al. |
| 2006/0096017 | A1 | 5/2006 | Yamasaki et al. |
| 2006/0260033 | A1 | 11/2006 | Preston |
| 2007/0061955 | A1 | 3/2007 | Asada et al. |
| 2007/0277302 | A1 | 12/2007 | Ichiki et al. |
| 2008/0271234 | A1 | 11/2008 | Okada et al. |
| 2008/0276362 | A1 | 11/2008 | O'Malley et al. |
| 2010/0125945 | A1 | 5/2010 | Hashem et al. |
| 2010/0186158 | A1 | 7/2010 | Morita et al. |
| 2011/0131717 | A1 | 6/2011 | Beale |
| 2011/0231989 | A1 | 9/2011 | O'Malley et al. |
| 2012/0210505 | A1 | 8/2012 | Pearson |
| 2012/0246817 | A1 | 10/2012 | O'Malley |
| 2013/0019391 | A1 | 1/2013 | Yoneda et al. |
| 2013/0047326 | A1 | 2/2013 | Yamasaki et al. |
| 2013/0047328 | A1 | 2/2013 | Yamasaki et al. |
| 2013/0047329 | A1 | 2/2013 | Yamasaki et al. |
| 2013/0047330 | A1 | 2/2013 | Yamasaki et al. |
| 2013/0067652 | A1 | 3/2013 | Murphy |

FOREIGN PATENT DOCUMENTS

| | | |
|---|---|---|
| DE | 9725 | 5/1880 |
| DE | 9884 | 6/1880 |
| DE | 25991 | 2/1884 |
| DE | 214437 | 10/1909 |
| DE | 2150451 | 4/1973 |
| DE | 4127835 | 12/1992 |
| EP | 0747545 | 11/1996 |
| EP | 2318601 | 5/2011 |
| EP | 2392378 | 12/2011 |
| EP | 2604761 | 6/2013 |
| FR | 856962 | 8/1940 |
| FR | 1200474 | 12/1959 |
| GB | 471058 | 8/1937 |
| GB | 519531 | 3/1940 |
| GB | 519533 | 3/1940 |
| GB | 524423 | 8/1940 |
| GB | 528110 | 10/1940 |
| GB | 531085 | 12/1940 |
| GB | 935949 | 9/1963 |
| GB | 983855 | 2/1965 |
| GB | 1036427 | 7/1966 |
| GB | 2012835 | 8/1979 |
| GB | 2045311 | 10/1980 |
| GB | 2057030 | 3/1981 |
| GB | 2203178 | 10/1988 |
| GB | 2431937 | 5/2007 |
| GB | 2453319 | 4/2009 |
| GB | 2466763 | 7/2010 |
| GB | 2470633 | 12/2010 |
| JP | 2952645 B | 9/1999 |
| JP | 2000-080711 | 3/2000 |
| JP | 2001-271407 | 10/2001 |
| JP | 2001-279789 | 10/2001 |
| JP | 2001-279791 | 10/2001 |
| JP | 2001-323541 | 11/2001 |
| JP | 2002-106048 | 4/2002 |
| JP | 2002-294842 | 10/2002 |
| JP | 2003-261978 | 9/2003 |
| JP | 2004-003384 | 1/2004 |
| JP | 2004-011413 | 1/2004 |
| JP | 2004-011414 | 1/2004 |
| JP | 2004-156308 | 6/2004 |
| JP | 2004-156309 | 6/2004 |
| JP | 2005-098005 | 4/2005 |
| JP | 2005-113642 | 4/2005 |
| JP | 2005-213881 | 8/2005 |
| JP | 2005-307622 | 11/2005 |
| JP | 2006-230980 | 9/2006 |
| JP | 2007-169964 | 7/2007 |
| JP | 2007-308911 | 11/2007 |
| JP | 2007-308912 | 11/2007 |
| JP | 2007-315011 | 12/2007 |
| JP | 2008-095436 | 4/2008 |
| JP | 2008-138419 | 6/2008 |
| JP | 2009-068223 | 4/2009 |
| JP | 2009-197506 | 9/2009 |
| JP | 2009-249819 | 10/2009 |
| JP | 2010-031551 | 2/2010 |
| JP | 2010-180587 | 8/2010 |
| JP | 2010-236320 | 10/2010 |
| JP | 2010-265693 | 11/2010 |
| JP | 2011-208362 | 10/2011 |
| JP | 2012-172403 | 9/2012 |
| JP | 2012-207503 | 10/2012 |
| JP | 2012-207504 | 10/2012 |
| JP | 2012-229569 | 11/2012 |
| JP | 2013-044179 | 3/2013 |
| JP | 2013-044180 | 3/2013 |
| JP | 2013-044181 | 3/2013 |
| JP | 2013-050027 | 3/2013 |
| KR | 100908083 | 7/2009 |
| KR | 101204787 | 11/2012 |

(56) References Cited

FOREIGN PATENT DOCUMENTS

| | | |
|---|---|---|
| WO | WO 99/29972 | 6/1999 |
| WO | WO 2001/53618 | 7/2001 |
| WO | WO 2003/102315 | 12/2003 |
| WO | WO 2004/082447 | 9/2004 |
| WO | WO 2004/109022 | 12/2004 |
| WO | WO 2006/079687 | 8/2006 |
| WO | WO 2009/030904 | 3/2009 |
| WO | WO 2011/004174 | 1/2011 |
| WO | WO 2012/140607 | 10/2012 |
| WO | WO 2012/140608 | 10/2012 |
| WO | WO 2013/083432 | 6/2013 |
| WO | WO 2013/087195 | 6/2013 |

OTHER PUBLICATIONS

International Search Report and Written Opinion dated Jun. 8, 2015 regarding Application No. PCT/US2015/021862.

SINGLE SWIRL RESULTS - AIR MOVEMENT

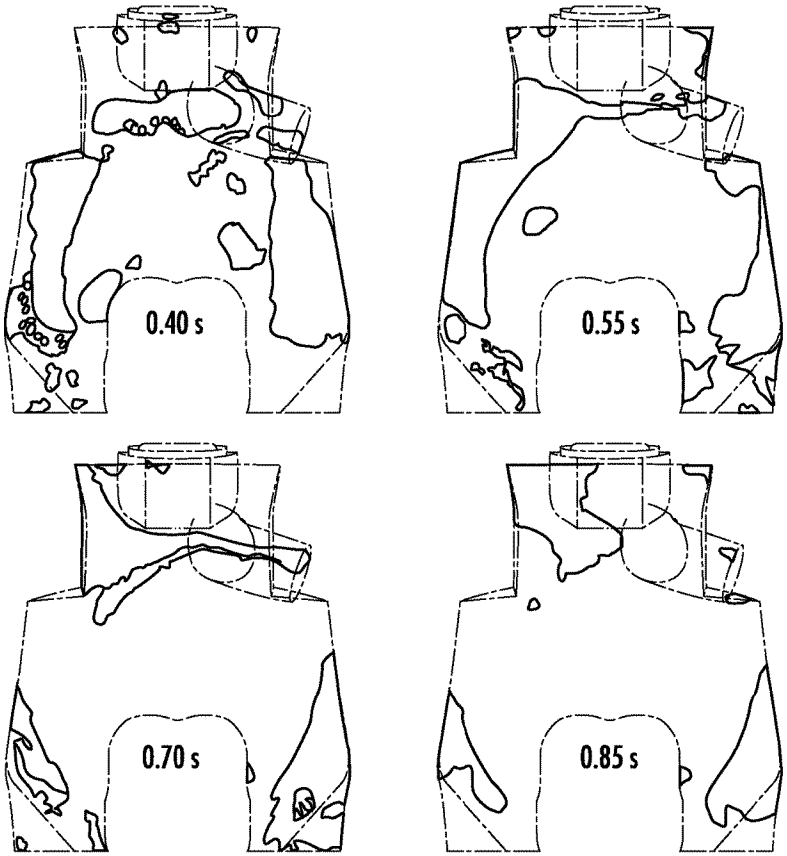

AIR VOLUME FRACTION IS SHOWN AT DIFFERENT POINTS IN TIME.

AT 0.40 sec EQUAL VOLUMES OF AIR IS SEEN IN THE TWO JET CHANNELS.

AT 0.55 sec AIR IS BEING PREFERENTIALLY EVACUATED FROM THE LEFT CHANNEL.

AT 0.70 sec AIR EVACUATION CONTINUES.

AT 0.85 sec NOTE THE LARGER AMOUNT OF AIR IN THE RIGHT JET CHANNEL.

THE RIGHT CHANNEL SEES A LARGER AIR OBSTRUCTION AND FLOWS LESS COMPARED TO THE LEFT CHANNEL.

THIS UNEQUAL AIR EVACUATION IS PARTLY RESPONSIBLE FOR REDUCTION IN JET FLOW RATE.

FIG. 12

RIMLESS TOILET

CROSS-REFERENCE TO RELATED PATENT APPLICATIONS

The present application is a Continuation of U.S. patent application Ser. No. 14/664,419, filed Mar. 20, 2015, which claims the benefit of and priority to U.S. Provisional Application No. 61/968,718, filed Mar. 21, 2014. The entire disclosures of the foregoing applications are hereby incorporated by reference herein.

BACKGROUND

The present application relates generally to the field of toilets (e.g., water closets, flush toilets, etc.). According to one aspect of the present application, a rimless toilet includes an improved jet hole (e.g., an orifice, hole, water jet, etc.) to more effectively utilize the flush water to clean the toilet bowl. Another aspect of the present application relates to an improved shelf (e.g., a ledge, terrace, bowl surface shape, etc.) for the rimless toilet that is configured to more effectively direct the flush water around the toilet bowl, and wash the bowl surface. One or both of these advantageous features may be employed in a particular toilet according to an exemplary embodiment.

Conventional toilets typically include a bowl that is configured to receive waste. Water is introduced into the bowl to wash the bowl and facilitate in transferring the waste to a drain, such as a municipal sewer drain. In view of a variety of factors, such as legislation regulating the amount of water a toilet may use per flush cycle and the cost and availability of municipal water, toilet manufacturers have tried to design toilets which have a more efficient flush cycle (i.e., the toilets use less water per flush cycle). As toilets use less and less water for a flush cycle, one challenge is to retain the effectiveness of the toilet to clean surfaces and evacuate waste from the bowl.

In toilets that include rims for directing flush water into the drain, a typical configuration includes an upper rim that may be positioned near the top of the bowl (e.g., overhanging the bowl) and that includes several holes (e.g., apertures, orifices, spray holes, jets, etc.) in an underside of the rim through which flush water may flow in order to wash the bowl and transfer any waste to a drain. One example of a conventional rim design is a box-type rim, which may have a closed, hollow cross-section through which water may flow. Another example of a conventional rim design is an open-type rim, which may have a cross-section shaped like an inverted "U." As compared to the box-type rim, the open rim does not include a bottom wall for at least part of its length.

Toilet rims, such as box-type rims and the open-type rims, typically overhang at least a portion of the toilet bowl (i.e., usually near an upper, outward portion of the toilet bowl). Consequently, water flowing from such a toilet rim typically enters a top portion of the toilet bowl from discretely positioned holes around the perimeter of the bowl. The relatively small size of these holes reduces the energy of the flowing water, and the discrete positions reduce the overall coverage of the surface cleansing water. Additionally, water that is retained within the rim and does not flow out of the rim wash holes flows backwards to a primary jet channel. This water is effectively wasted as it does not contribute to the cleaning of the bowl surface or to bulk waste removal. Therefore, water efficiency is undesirably reduced in these toilets.

Further, the bowl surface directly underneath an overhanging closed or open rim and the underside of the rim itself may be concealed from view to a user looking down on the bowl from above. Accordingly, these portions of toilet bowl surface might be inadvertently neglected when the user cleans the toilet. As a result, waste and contamination (e.g., bacteria) may undesirably collect underneath an overhanging toilet rim.

Recently, there has been increased interest in designing toilets that do not include a typical rim for distributing water about the bowl. Some of these designs incorporate a bowl design that includes features intended to keep the water swirling about the bowl from splashing upward toward a user, such as a top portion of the bowl that curves inward toward the center of the bowl to create a "channel" in which the water will travel (see, e.g., FIG. 1A). Such features result in an "undercut" configuration for the bowl, which may undesirably increase the overall cost to manufacture the toilet bowl since additional molding steps may be required to form the undercut features. It would be advantageous to provide a rimless toilet that is configured to prevent water from splashing out of the bowl, but that does not include an undercut feature such as that described above.

Known rimless toilets typically include one or two primary orifices (water jets, jet holes, etc.) to introduce flush water into the toilet bowl. In cases where the toilet utilizes a pressurized water supply, one jet hole may be used. In gravity-fed toilets, however, two jet holes are typically used because the configuration of the toilet system may not provide adequate water pressure for one jet hole to distribute flush water around the entire surface of the toilet bowl. As an example, gravity-fed rimless toilets may include two water jets near the rear of the toilet bowl such that each jet hole may be used to wash approximately 50% of the toilet bowl (see, e.g., FIG. 1B, showing a toilet having a bowl 1 and two water jets 5 directing water outward from a manifold 3 at the rear of the bowl 1). It would be desirable from a manufacturing standpoint to provide a rimless gravity-fed toilet that utilizes only a single jet hole to introduce flush water into the bowl.

For gravity flush toilet products using two bowl wash jets, there are two typical configurations, the first is to direct both of the jets in the same direction, and the other is to direct the water in opposite directions; typically from the back of the bowl with water flowing toward the front of the bowl. Both of these configurations result in performance issues. With both bowl wash jets flow in the same direction, one of the jet feed paths must bring the wash water from the back of the bowl, and then turn the direction of the water 180 degrees with a U-turn in the flow channel. This substantially reduces flow velocity and energy that could be used to wash the bowl. With the dual opposing jet configuration, no water flow energy is lost, but wash water must be provide with a secondary means to the back of the toilet bowl between the opposing jets. This is typically done with such means as a separate nozzle, added ceramic pieces, or special hole cutting methods. These special efforts result in additional cost and complexity.

One tactic used by manufacturers of gravity-fed rimless toilets to increase the flow velocity of the flush water exiting the jet holes is to decrease the size of the jet hole. One tradeoff of employing smaller jet holes, however, is that the water flowing through the hole will have increased turbulence, thus increasing the likelihood that water will splash out of the bowl toward a user. It would be advantageous to employ a jet hole that decreases the amount of turbulence in the flush water while maintaining or improving the velocity of the flush water being introduced through the hole.

Accordingly, it would be advantageous to provide a rimless toilet design that addresses one or more of the issues discussed above, and that is relatively simple and efficient to manufacture.

SUMMARY

According to an exemplary embodiment, a toilet includes a bowl and a vertically-elongated jet hole located near a top of the bowl between a rear of the bowl and a side of the bowl. The vertically-elongated jet hole is configured to direct flush water around an inner surface of the bowl to wash the inner surface of the bowl.

According to another exemplary embodiment, a toilet includes a bowl having a vertically-elongated jet orifice near a top of the bowl that is configured to introduce flush water into the bowl from an interior water channel through a surface of an inner wall of the bowl, and the flush water is directed around the inner wall of the bowl to wash the inner wall. The toilet also includes a shelf for directing the flush water, and the toilet is a gravity-fed toilet that does not include an overhanging rim.

According to another exemplary embodiment, a toilet includes a tank configured to contain flush water, a bowl having an opening, an outlet, a jet hole in fluid communication with the tank via a water channel, a valve to control water through the water channel during a flush cycle, and a shelf configured to distribute water from the jet hole around the bowl. The jet hole is elongated in a vertical direction such that the height of the hole is greater than the width of the hole at its greatest width.

BRIEF DESCRIPTION OF THE DRAWINGS

FIG. 12 illustrates the movement of air in a jet channel of a toilet.

DETAILED DESCRIPTION

As discussed in the background section, there are certain shortcomings in the field of known rimless toilet designs and in the manner in which flush water is introduced into such toilets. The present application discloses various embodiments intended to address one or more of these deficiencies, as will be discussed in greater detail below.

According to an exemplary embodiment, an improved rimless toilet is configured to provide effective bowl wash, ease of cleaning, and simplified low-cost manufacture. According to this embodiment, water from the toilet tank flows through a single jet orifice (e.g., hole, rim orifice, etc.) located towards the rear of the toilet bowl, near the top thereof. The water flows onto a shelf (e.g., terrace, ledge, plateau, protrusion, etc.) around the inside periphery of the bowl, which allows the water from a single orifice to flow completely around the periphery of the bowl. By controlling the shape, angle, length, and depth of the shelf, the amount of water that flows around the periphery and down the side of the bowl can be controlled, thus washing the sides of the bowl completely. The water flowing from a single jet hole (e.g., bowl wash jet, etc.) also creates a swirling flow in the toilet bowl aiding in the flushing action of the toilet, better removing waste contents in the bowl. By using an open shelf approach to distributing bowl wash water, there are no overhangs or undercuts of the ceramic bowl material. By doing this, the casting process to make this product is greatly simplified, and the toilet bowl can be completely cast with a simple four-part mold.

Additionally, the inventors of the present application have discovered that by increasing the dimensions of the jet orifice or hole, the splattering (i.e., turbulence, etc.) of the flush water entering the bowl may be advantageously lessened. Thus, increasing the dimensions of the jet orifice may allow for improved flow characteristics of flush water. For example, increased dimensions of the jet orifice may allow greater retention of energy of the flush for a longer period, as well as a reduced likelihood of water splashing out of the bowl. Such an improved jet orifice configuration may be used in rimless toilets that incorporate a shelf or ledge for directing the flow of the water around the inner surface of the bowl and may also advantageously allow for the manufacture of rimless toilets that do not include shelves or ledges (thus simplifying the design and providing for improved aesthetics for the toilet).

Figure 1A:
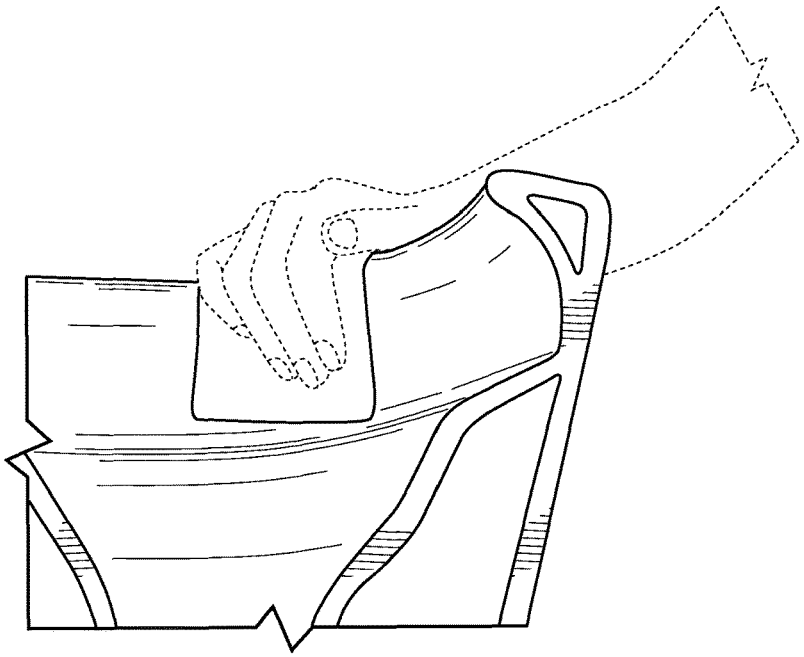
FIG. 1A PRIOR ART
FIG. 1A illustrates a cutaway view of a prior art rimless toilet.
Figure 1B:
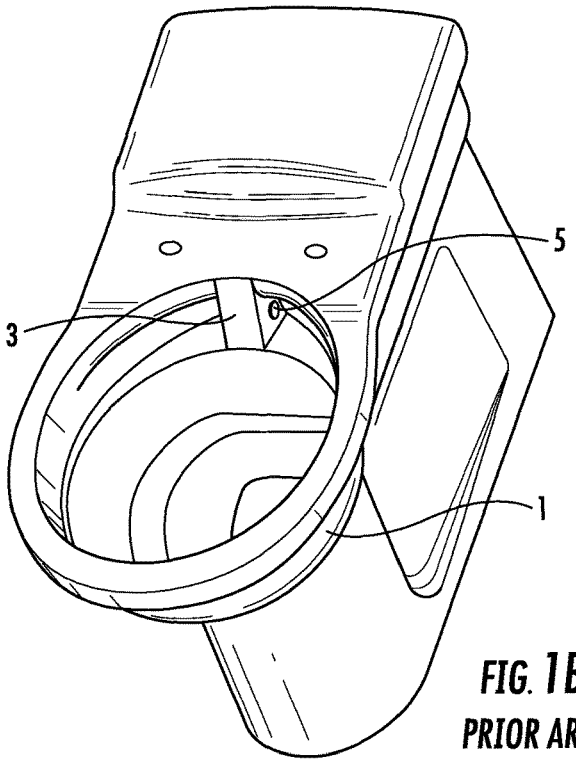
FIG. 1B PRIOR ART
FIG. 1B illustrates a perspective view of another prior art rimless toilet.
Figure 2:
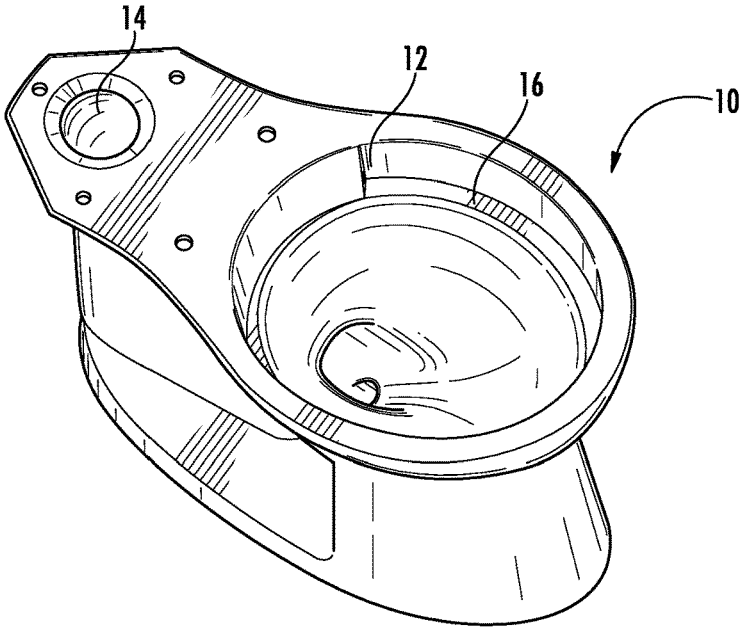
FIG. 2 illustrates a perspective view of a rimless toilet according to an exemplary embodiment.
Figure 3:
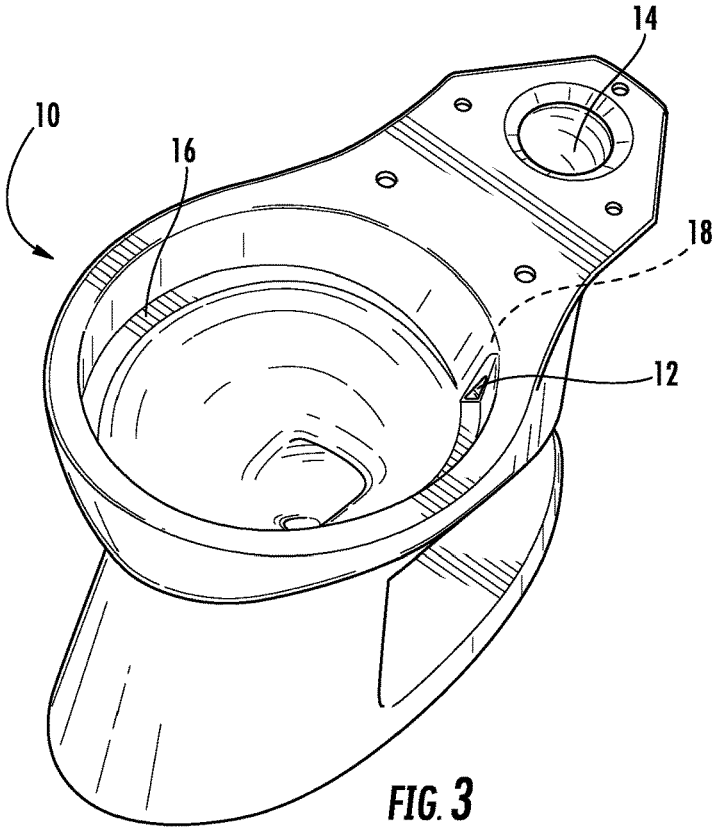
FIG. 3 is another perspective view of the rimless toilet shown in FIG. 2.

Referring to FIGS. 2-3, according to an exemplary embodiment, a rimless toilet includes a toilet bowl 10 having a jet hole 12 that is positioned near the top of the bowl at between approximately a one o'clock position and a two o'clock position (i.e., the rearmost portion of the toilet bowl 10 being 12 o'clock). In other words, the jet hole 12 is positioned approximately between the rearmost portion of the bowl 10 and a lateral side (either a left or right side, although shown in FIGS. 2-3 as the right side from the perspective of an individual standing in front of the toilet facing the toilet) of the bowl 10. For example, the position of the jet hole 12 may be approximately 30-60° laterally (e.g., to the left or right) of the rearmost portion of the bowl 10. For example, 30° to the right of the rearmost portion of the bowl 10 (as seen from a top view, while standing in front of the bowl 10) would correspond to a one o'clock position and 60° would correspond to a two o'clock position. Similarly, 30° to the left of the rearmost position would correspond to an eleven o'clock position, and 60° to the left would correspond to a ten o'clock position. It should be understood that the jet hole 12 may be located at any suitable position within the bowl 10, and that the positions of the jet hole 12 disclosed herein are not intended as limiting.

In addition to washing the bowl 10, the jet hole 12 is the only vent in the system. That is, during a flushing cycle, air within a water channel 18 between the jet hole 12 and an inlet 14 is vented through the jet hole 12 only.

A shelf 16 (ledge, terrace, etc.) is positioned below the jet hole 12 and is configured to guide flush water around the periphery of the bowl 10 such that water is distributed around the bowl surface. In other words, the shelf 16 is configured such that water distributed from the jet hole 12 is swirled around the toilet bowl 10. According to other exemplary embodiments (e.g., as shown in FIG. 12), the toilet bowl may be provided without a shelf, or with a partial shelf, for distributing the flush water.

Figure 4:
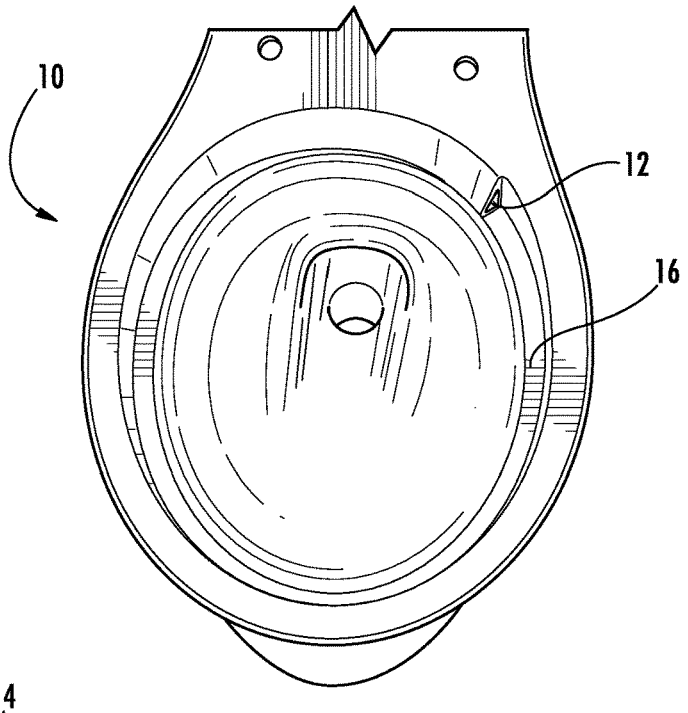
FIG. 4 is a top perspective view of the rimless toilet shown in FIG. 2.

Still referring to FIGS. 2-4, the bowl 10 includes an inlet 14 configured to receive flush water from a source. According to an exemplary embodiment, the inlet 14 is configured to be fluidly coupled to a tank (not shown) or another source in a gravity-fed arrangement. Thus, the rimless toilet shown in FIGS. 2-4 is a gravity-fed toilet. A valve (not shown, but positioned between the inlet 14 and a tank) may be used to control water through a water channel (see, e.g., the water channel 18 shown in FIGS. 3 and 5) during a flush cycle. According to other exemplary embodiments, the bowl 10 may be provided with an inlet that is intended to couple to a pressurized source of water.

A water channel or chamber 18 behind the jet hole 12 is provided for supplying the flush water from the inlet 14 to the jet hole 12. Prior to a flushing action, a pocket (e.g., a volume, quantity, etc.) of air resides within the water channel 18 and the jet hole 12. During a flushing action, water flows from a water supply (e.g., a water tank, pressurized water supply, etc.) through the inlet 14, the water channel, and the jet hole 12. As water flows through the water channel and the jet hole 12, the pocket of air residing therein is displaced (e.g., evacuated). Smaller water channels and shorter jet holes provide less room and less opportunity for displacement of air. If the pocket of air is not adequately displaced during a flushing action, the air may become entrained within the flush water as bubbles, which increases the flow resistance of the flush water, and the splatter of the water issuing from the jet hole.

In an effort to provide a smoother and less turbulent flow of flush water through the jet hole 12, the inventors experimented with various shapes and positions of the jet hole 12 relative to the inlet 14, as well as the ratio of jet hole size to sump jet orifice size (i.e., a hole in or near the toilet bowl sump area (not shown in accompanying figures, but well known in the art as being positioned near the bottom of the bowl to direct water toward the toilet sump). The sump jet orifice directs flush water into a sump of the bowl. Because the water supplied during a flushing cycle flows to either the jet hole 12 or a sump jet orifice, the relative sizes of the jet hole 12 and the sump jet orifice will determine the quantity of water that flows to the jet hole 12 and the sump jet orifice. During experimentation, the inventors have found that if the jet hole 12 is too small, venting will be inadequate and the flushing cycle will become slower as more air is trapped within the water channel 18. On the other hand, if the jet hole 12 is too large, too much flush water will be directed to the rim, and siphon priming will be slower (e.g., decreased). Other effects of a jet hole 12 that is too large include a higher propensity for water splashing out of the bowl 10, and a poorer distribution of flush water on the bowl 10 (mostly at locations just below the jet hole 12). Through experimentation, the inventors have found that a ratio of the area of the vertically-elongated jet orifice to the area of the sump jet orifice of approximately 0.5 and 5.0 provides for adequate venting through the jet hole 12, optimal distribution of flush water on the bowl 10, and adequate siphon priming.

Figure 5:
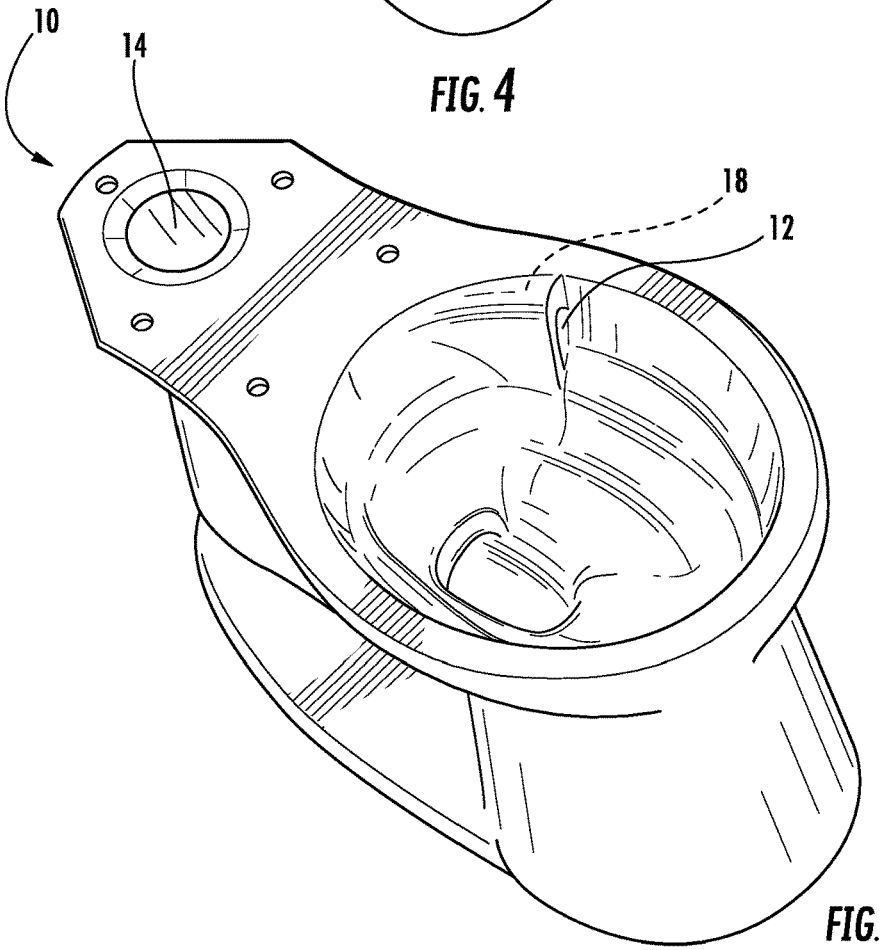
FIG. 5 illustrates a perspective view of a rimless toilet, according to another exemplary embodiment.
Figure 6:
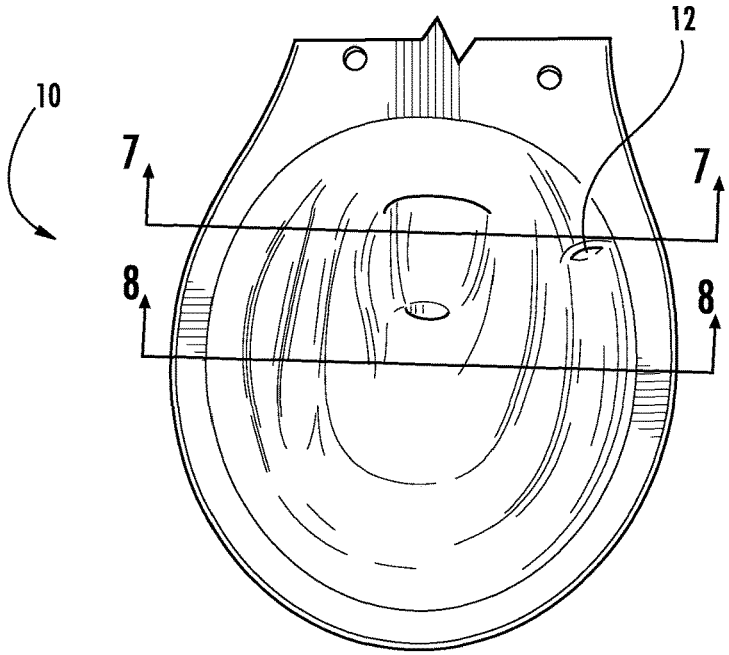
FIG. 6 is a top perspective view of the rimless toilet shown in FIG. 5.
Figure 7:
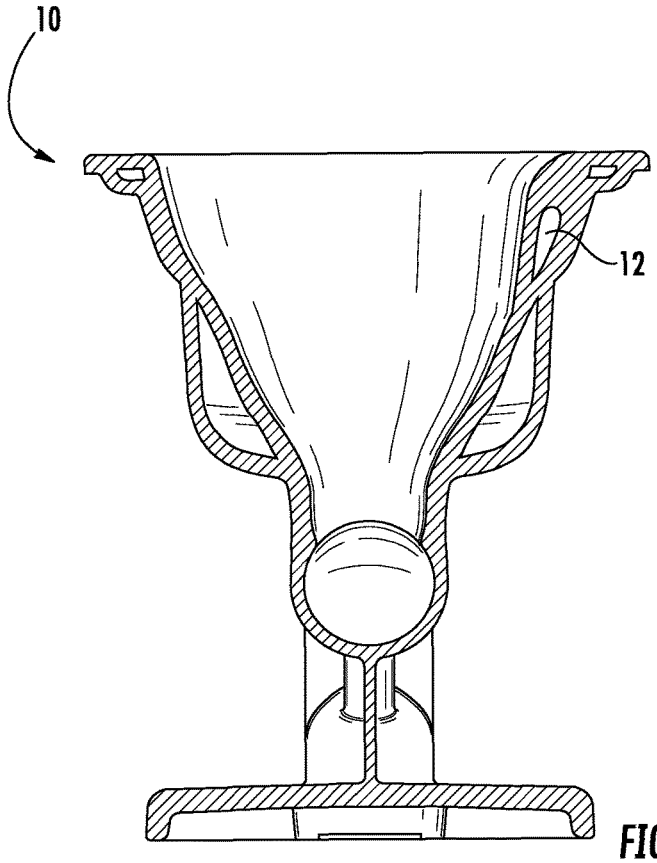
FIG. 7 is a cross-sectional view of the rimless toilet shown in FIG. 6, taken along the line 7-7.

Referring now to FIGS. 5-7, according to an exemplary embodiment, a rimless toilet 10 is shown, which includes an inlet 14 and a jet hole 12. The jet hole 12 may be approximately 30-60° to the left or right of the rearmost portion of the bowl 10. According to another exemplary embodiment, the jet hole 12 may be up to approximately 90° to the left or right of the rearmost portion of the bowl 10. As shown in FIGS. 5-8 (and most easily seen in FIG. 8), the surface of the bowl is configured as having a concave portion which transitions into a convex portion, and the jet hole 12 is positioned above the convex portion. This shape may advantageously allow water dispensed from the jet hole 12 to flow around the bowl 10, and at least a portion of the water dispensed from the jet hole 12 may make a complete revolution around the bowl 10. The water may "ride" along the convex portion similar to the way water would travel along the shelves described above with respect to FIGS. 2-4. Thus, cleaning of the toilet bowl 10 may be greatly improved. Similar to the toilet 10 shown in FIGS. 2-4, air may be evenly displaced from within a water channel between the jet hole 12 and the inlet 14. Thus, the improved jet hole 12 reduces splashing and provides for a less turbulent flow of flush water. As a result, an upper portion of the toilet bowl 10 may be designed without any overhangs or undercuts of the ceramic bowl material.

Figure 8:
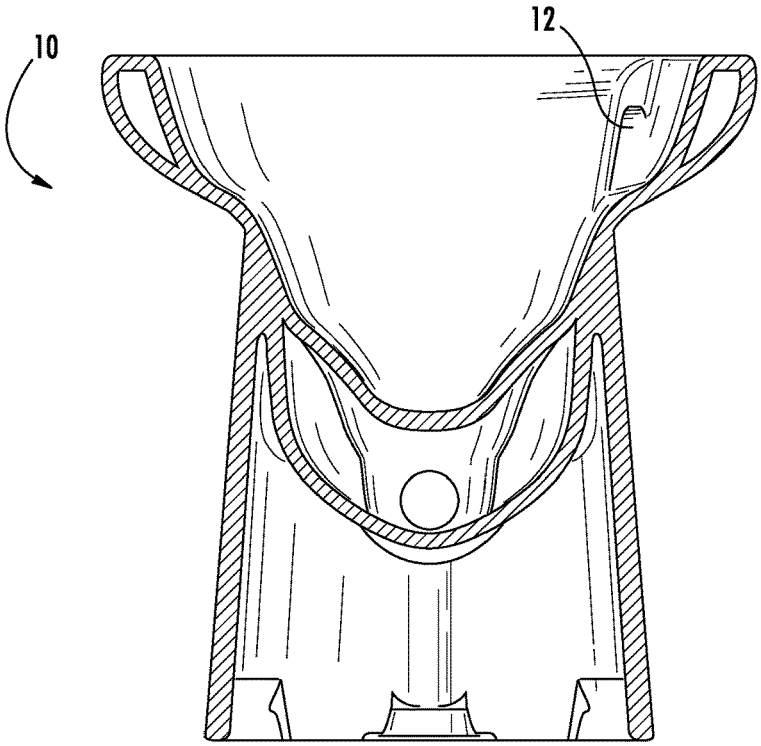
FIG. 8 is a cross-sectional view of the rimless toilet shown in FIG. 6, taken along the line 8-8.

Referring now to the cross-sectional view of FIG. 8, the curvature of the bowl 10 is shown. According to an exemplary embodiment, the curvature of the bowl 10 is configured to facilitate the flow of flush water from the jet hole 12 around the bowl 10, and as the flush water makes a revolution around the bowl, at least a portion of the flush water washes down every portion of the bowl in order to effectively wash the bowl. The bowl curvature shown in FIG. 8 includes a concave portion which is positioned above a convex portion. The jet hole 12 is vertically aligned above the convex portion. Thus, the concave portion of the bowl 10 is designed to carry flush water around the bowl 10.

Figure 9:
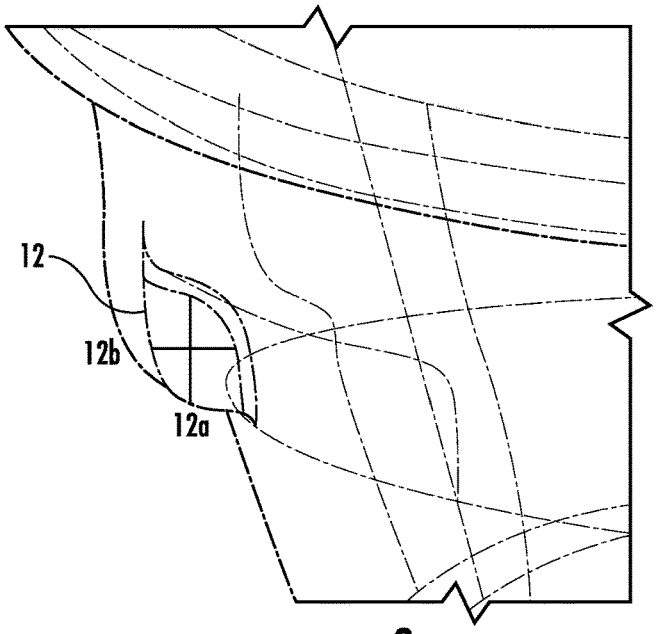
FIG. 9 is a detail view of an elongated jet hole of a rimless toilet.

Referring now to FIG. 9, according to an exemplary embodiment, a major axis 12*a* may define a height of the jet hole 12, and a minor axis 12*b* may define a width of the jet hole 12. In other words, the jet hole 12 may be vertically elongated such that a height of the hole is greater than the width of the hole at its greatest width (e.g., oval or slot-shaped). According to an exemplary embodiment, the effectiveness of the water flow through the jet hole 12 and the length of the major axis 12*a* may be directly proportional. In other words, as the length of the major axis 12*a* increases, the flow rate of flush water through the jet hole 12 may increase. According to an exemplary embodiment, the length of the major axis 12*a* is at least 1⅛" long. According to another exemplary embodiment, the length of the major axis 12*a* is at least 1¼" long. According to yet another exemplary embodiment, the length of the major axis 12*a* is at least 1⅜" long. It should be understood by those skilled in the art that the length of the major axis 12*a* may be any suitable length, and that the lengths disclosed herein are not limiting.

Figure 10:
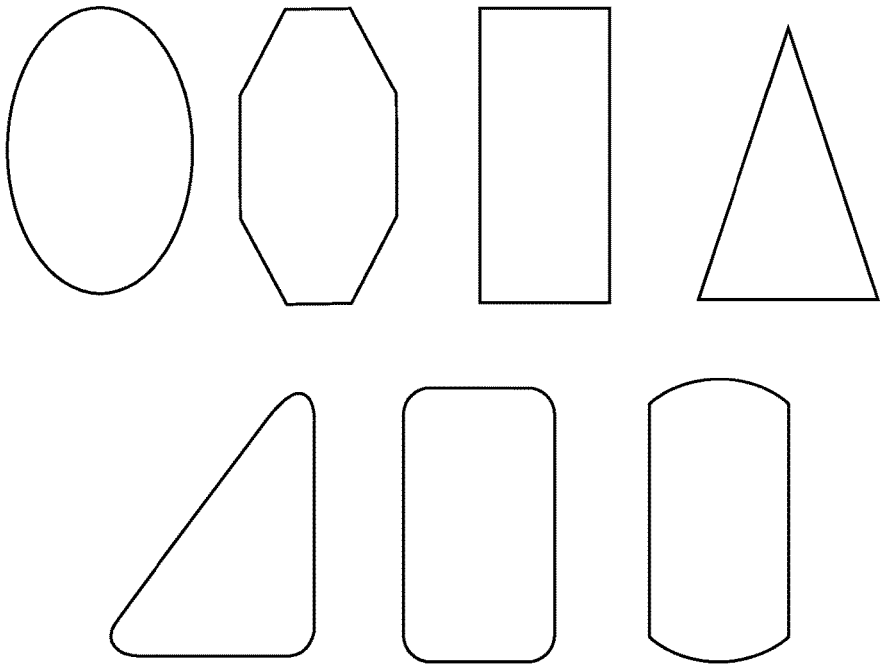
FIG. 10 illustrates various shapes of an elongated jet hole of a rimless toilet.

Referring to FIG. 10, according to an exemplary embodiment, the jet hole may have any suitable shape, such as generally oval, slot-shaped, egg-shaped, hexagonal, polygonal, or may have any other suitable shape. It should be understood that the shapes of a jet hole disclosed herein are not limiting. The surface surrounding the jet hole may also be on various compound angles or have various baffling features to conceal the jet hole or reduce the amount of splatter during a flush.

As pointed out above, the inventors experimented with different sizes and shapes of jet holes in order to discover the effects on flow rate of flush water. For example, referring to FIGS. 11A and 11B, experimental data demonstrates the differences in flow rates over time among three different toilet configurations. The first toilet configuration is referred to as the "Iter1," which includes two jet holes. The second and third toilet configurations are referred to as the "Single Swirl small" and the "Single Swirl large," respectively, which each include one jet hole. In particular, the area of the Single Swirl large jet hole is 0.65 in.$^2$ (nominally, 0.87" high by 0.75" wide) and the Single Swirl small jet hole is 0.40 in.$^2$ (nominally, 0.68" high by 0.60" wide). For the three toilet configurations, flow rate measurements were taken at the tank (see, e.g., the top line charts in FIGS. 11A and 11B), the jet hole (see, e.g., the middle line charts shown in FIGS. 11A and 11B), and the bottom jet near the trapway (see, e.g., the bottom line charts shown in FIGS. 11A and 11B).

Referring to the top line charts for the tank flow rate, several distinctions are obvious. First, the water flowed over 0.5 seconds longer through the tanks of the "Single Swirl small" and the "Single Swirl large" toilets (i.e., compared to the Iter 1 toilet). Second, whereas the tank of the Iter 1 toilet experienced a spike in the water flow rate at approximately 0.5 seconds, the tanks of the "Single Swirl small" and the "Single Swirl large" experienced a drop in the water flow rate at approximately the same time. One explanation for the decrease in the Single Swirl toilets is that more air is locked in the single swirl supply. As a result, the flow rates from the tank are slightly reduced.

Between 0.5-1.0 seconds, the flow rates out of the three tanks becomes nearly constant (steady-state) until the valve closes (i.e., drops), after which the flow rate from the tank is zero. Accordingly, it can be seen in the middle and bottom line graphs that the rim and jet flow rates experience a drop at approximately the same time that the valve closes. In particular, the steady-state portion of the "Iter 1" appears to last for approximately 0.5 seconds, whereas the steady-state portions of the "Single Swirl small" and the "Single Swirl large" appear to last for approximately 1.3 seconds and 1.2 seconds, respectively. The longer steady-state flow rates from the tanks of the Single Swirl toilets may be attributed to a larger amount of actual water in the tank (sometimes referred to as "ATW," or "actual tank water," which represents the amount of water that flows from the toilet tank to the toilet bowl during a flush cycle).

Figure 11A:
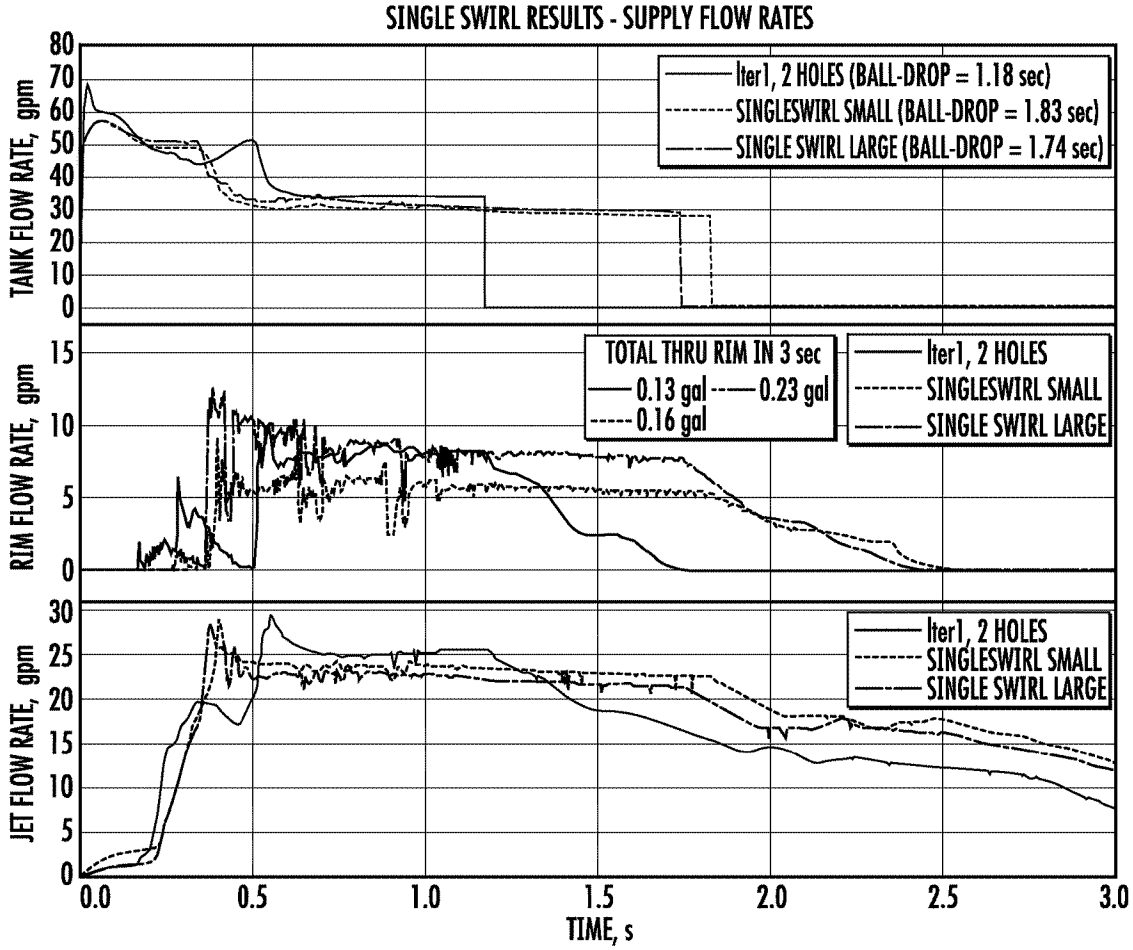
FIGS. 11A and 11B illustrate three line graphs for the flow rates of three different toilets.
Figure 11B:
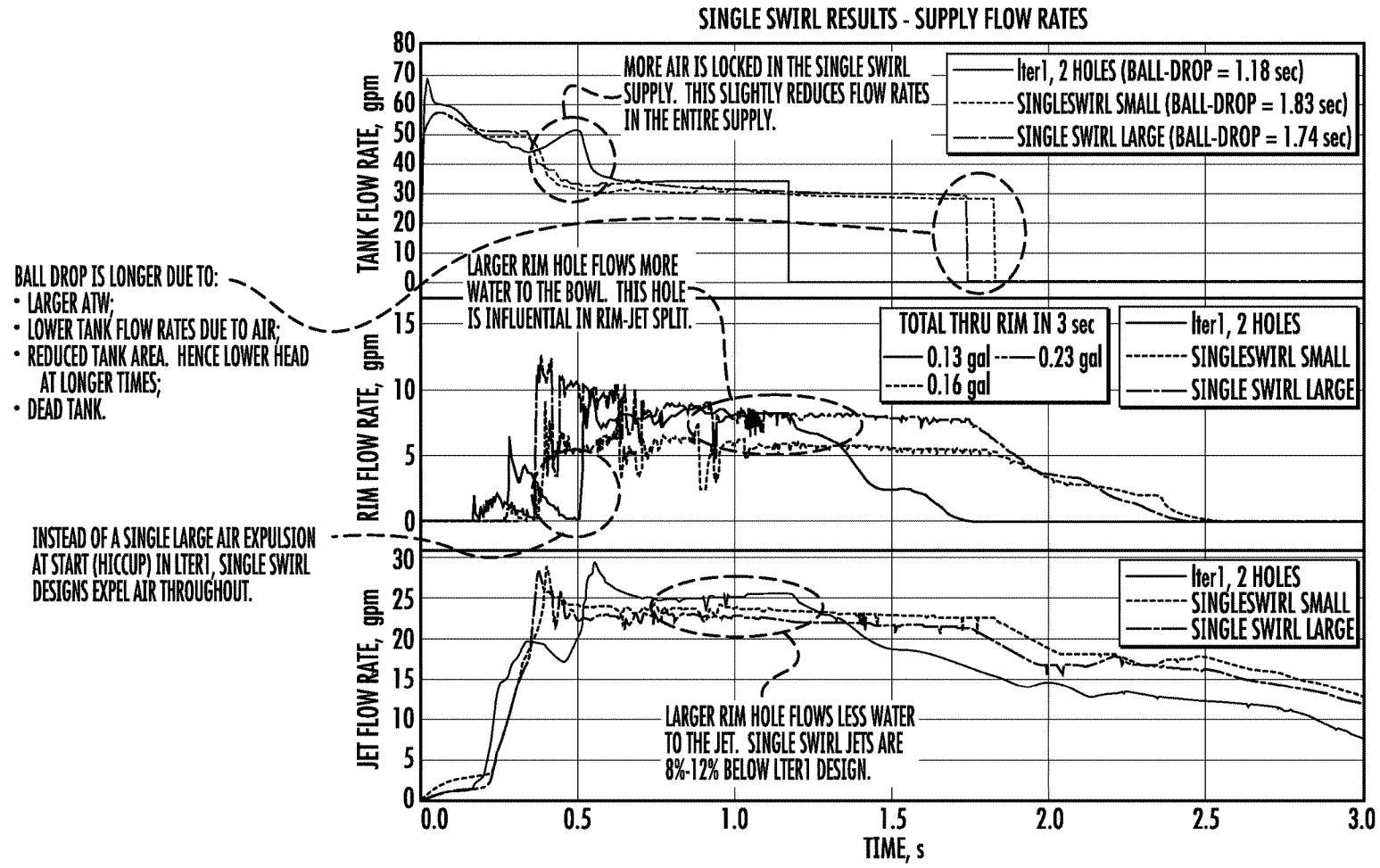

Referring to the middle line charts in FIGS. 11A and 11B, the Iter1 toilet experienced an initial spike in its rim flow rate, which was followed by a drop and another spike (a "hiccup"). In contrast, the rim flow rates of the Single Swirl toilets experienced an initial spike and then a rather even (i.e., steady, constant, etc.) flow rate until the valve closed. One explanation for the steady flow rate of the Single Swirl toilets is that these toilets are designed to expel air throughout the duration of the flush cycle. Further, the flow rate at the jet hole of the Single Swirl large appears to be greater than that of the Single Swirl small, which is attributed to the larger jet hole of the Single Swirl large. The experimenters measured overall jet hole cumulative water volumes of 0.13, 0.16, and 0.23 gallons for the Iter1, the Single Swirl small, and the Single Swirl large, respectively.

Referring to the bottom line graphs in FIGS. 11A and 11B, the Iter1 toilet experienced an initial "hiccup" in the bottom jet flow rate. In contrast, the bottom jet flow rates of the Single Swirl toilets experienced an initial spike and then a rather steady flow rate until the valve closed. The steady flow rate experienced by the Single Swirl toilets represents that air is evenly evacuated from the jet hole during the flush cycle. Also, the steady-state flow rate of the Iter1 appears to be approximately 8-12% greater than the steady-state jet flow rates of the Single Swirl toilets. One reason for this difference is that the larger jet hole of the Single Swirl designs results in less water flowing to the sump jet.

Another aspect that the inventors measured was the distribution of air over time within a water channel. For example, referring to FIG. 12, the movement of air over time in the Single Swirl toilet (having a larger jet opening of 0.65 in.$^2$) is shown. At 0.40 seconds, the left and right jet channels appear to contain approximately equal amounts of air. At 0.55 seconds, air is preferentially evacuated from the left channel. Air continues to evacuate from the left channel at 0.70 seconds. At 0.85 seconds, the right channel appears to contain a larger amount of air than the left channel. One reason for the reduction in the jet flow rate of the Single Swirl toilets is the unequal air evacuation between the left and right channels.

Yet another feature that the inventors investigated was the distribution of flush water along the toilet bowl surface of the Single Swirl toilets. Computer simulation of the bowl wash of this bowl configuration shows that a larger bowl wash jet provides better coverage of the bowl (i.e., the water washing over the bowl surface is more evenly distributed). This indicates that there may be more water available for the Single Swirl toilets. Momentum and the volume of water cause the water to ride higher along the terrace. As water flows along the terrace, a fraction of the water is shed therefrom causing the water above it to fall lower and ride the terrace. This allows a portion of the water to complete the path around the entire length of the terrace and make a complete revolution around the toilet bowl.

Figure 13:
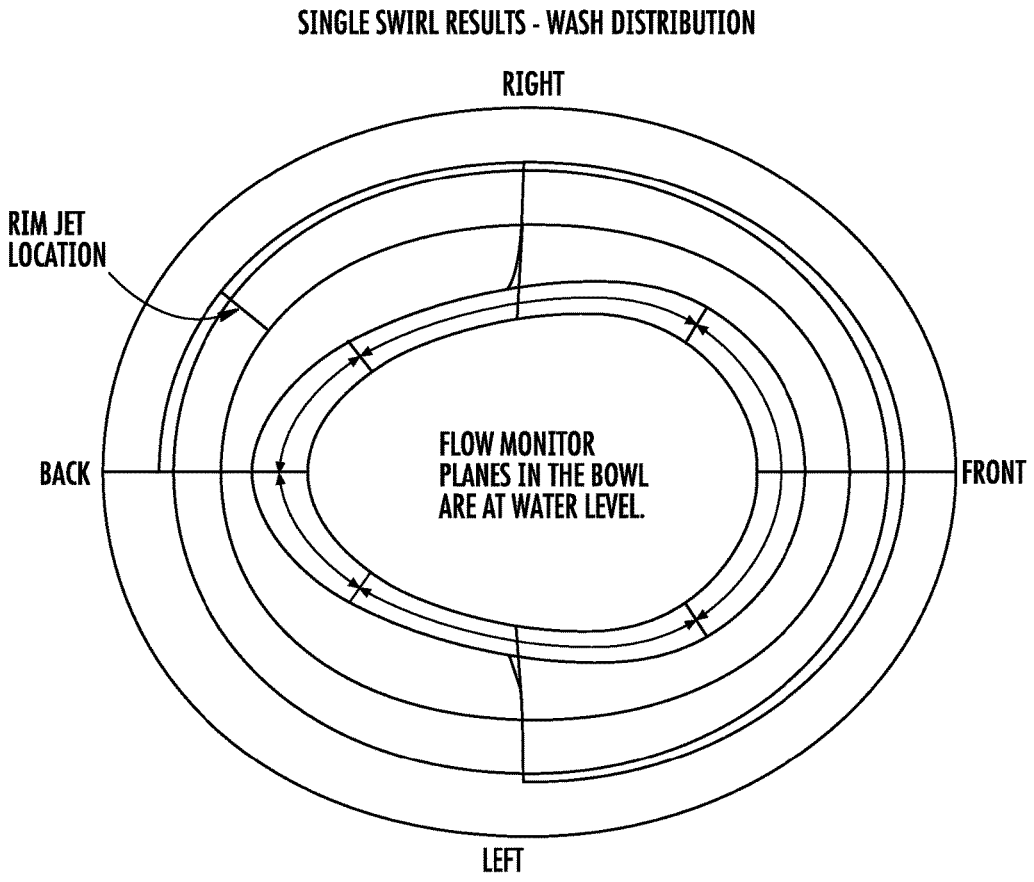
FIG. 13 illustrates the different areas included in the graphs shown in FIGS. 14A and 14B.

Referring to FIG. 13, four quadrants of the Single Swirl toilet bowl surfaces are illustrated in a schematic form. In particular, the four quadrants (i.e., sections) that are shown include the front, left, back, and rear. Further, the jet hole is located between the back and right quadrants (e.g., between the 1:00 and 2:00 positions when looking down at the toilet bowl, where the 12:00 position is at the back or rear of the bowl).

Figure 14A:
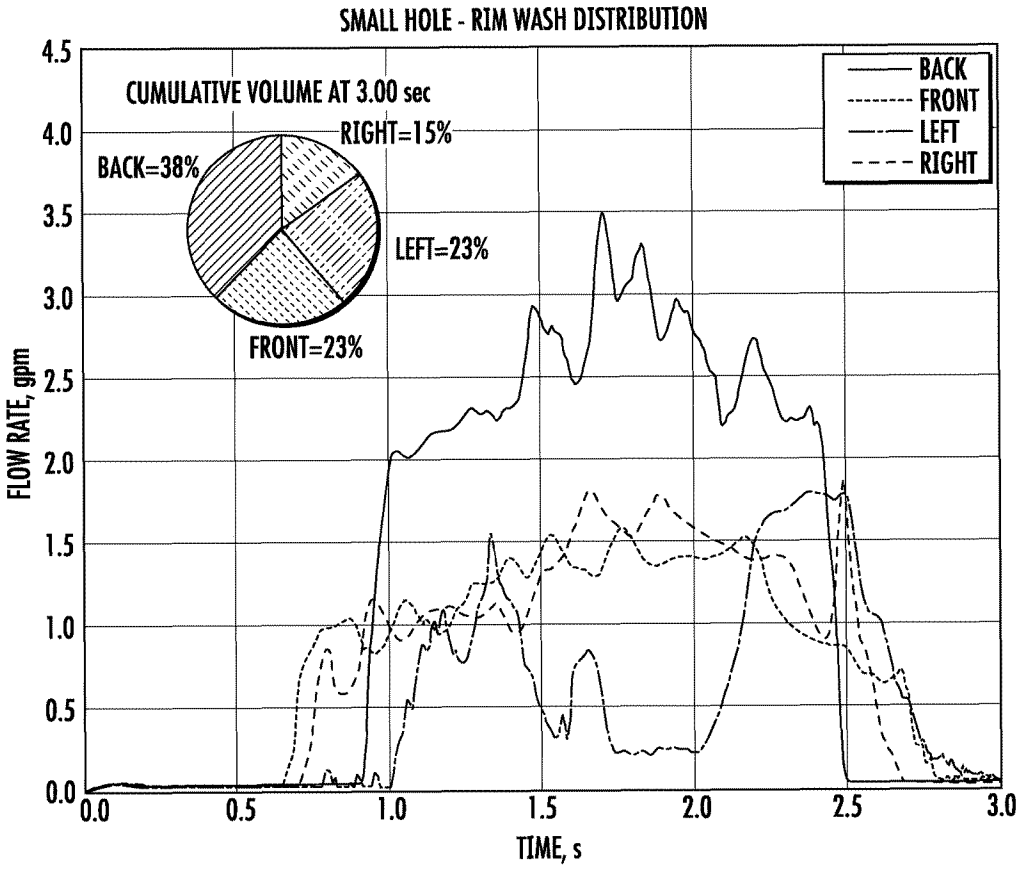
FIGS. 14A and 14B are graphs illustrating the distribution of water in a toilet bowl over time.
Figure 14B:
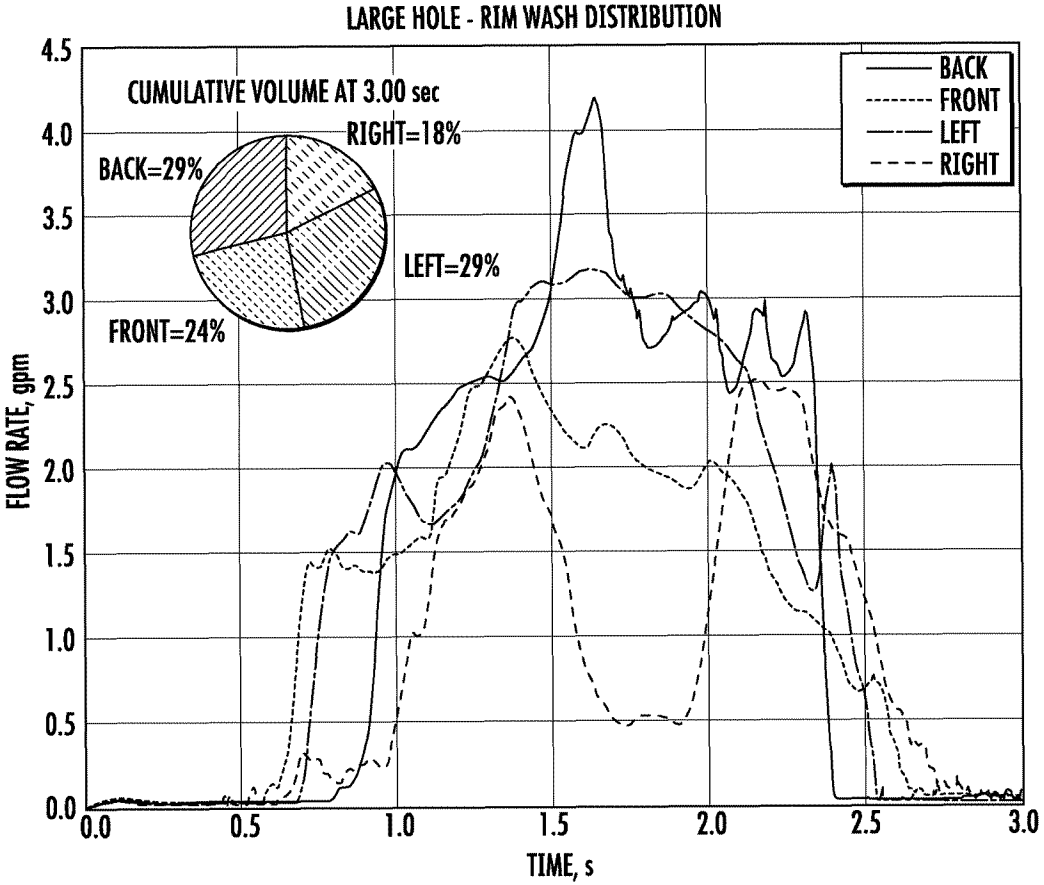

FIG. 14A shows the distribution of flush water for the Single Swirl small toilet. As FIG. 14A shows, approximately 15% of the flush water during a flush cycle flows down the right section, 23% flows down the left section, 23% flows down the front section, and 38% flows down the back section. Alternatively, FIG. 14B shows the distribution of flush water for the Single Swirl large toilet. As shown, approximately 18% of the flush water flows down the right section, 29% flows down the left section, 24% flows down the front section, and 29% flows down the back section. Thus, the flush cycle of the Single Swirl large toilet is generally more evenly distributed than the Single Swirl small toilet. In addition, for the Single Swirl large toilet, water from the flush cycle flows further around the bowl (such that some of the water flows to at least a rearmost portion of the toilet bowl and wraps nearly around the bowl almost to the jet hole).

Based on experimentation between the Single Swirl toilets and the Iter1 toilet, it is evident that the size and shape of the jet hole influences the distribution of flush water around the toilet bowl. For example, the single swirl designs may retain more air in the water channel, which may result in reduced jet flow rates of approximately 8-12%. Further, larger jet holes may wash the toilet bowl surface better than smaller jet holes.

According to an exemplary embodiment, in addition to increasing the flow rate of flush water through a jet hole, an orifice that is formed as an elongated hole may provide ancillary improvements to a toilet system. Such a toilet may also be more aesthetically pleasing than conventional toilets.

According to an exemplary embodiment, the proportion or ratio of a length of a major axis of an elongated hole relative to the distance between a bottom edge of the hole and a bottom edge of the inlet of the bowl may provide ancillary effects which are similar to those described above in regards to the elongated shape of a jet hole (i.e., reduced splash, reduced sound, etc.).

According to an exemplary embodiment, because the improved jet hole 12 reduces splashing and provides for a less turbulent flow of flush water, an upper portion of the toilet bowl 10 may be designed without any overhangs or undercuts of the ceramic bowl material. Accordingly, the casting process to make the toilet 10 may be greatly simplified.

Figure 15:
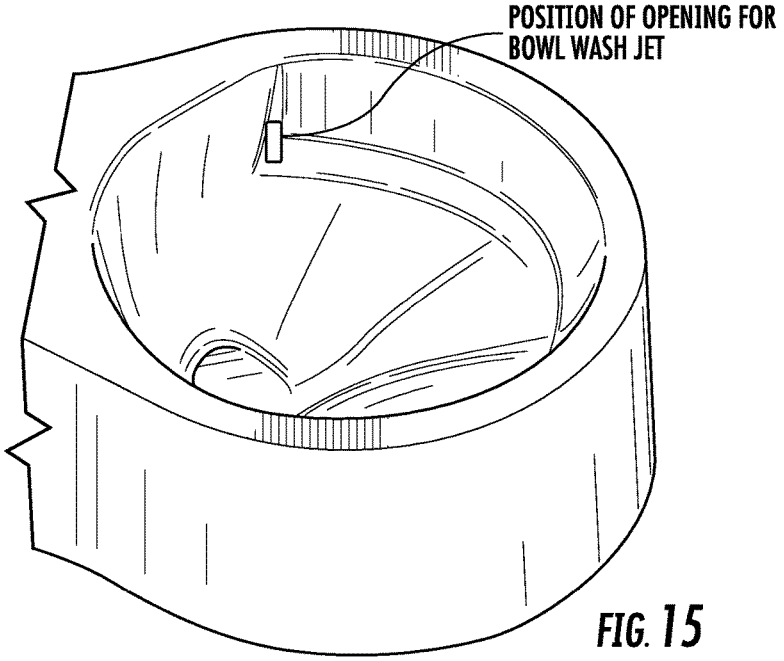
FIG. 15 is a rimless toilet according to another exemplary embodiment that does not include an elongated shelf or terrace for directing water around the inner surface of the bowl.

Because of the improved flow characteristics attributable to the improved jet hole, the flush water flowing from the jet hole has sufficient kinetic energy and volume to flow around all four quadrants/sections (i.e., front, back, left, and right) of the toilet bowl. This may allow for the production of rimless toilets that include shelves or terraces or which omit such features (as illustrated, for example, in FIG. 15).

According to one exemplary embodiment as shown, for example, in FIGS. 2-4, the toilet bowl 10 may include a single terrace (i.e., a ledge, shelf, ramp, etc.) that is used and configured to direct flush water along a specific flow path. Such a terrace is configured to provide some initial direction (i.e., guidance) to the flush water flowing from the jet hole. The kinetic energy of the water flowing from the jet hole 12 may be sufficient to carry the water along a flow path established by the terrace.

Referring to FIGS. 2-4, a toilet may include a single terrace that extends from approximately a jet hole, around a front of the toilet bowl, and to approximately a rear portion of the bowl (see, e.g., a terrace 22 shown in FIG. 3). However, it should be understood that a toilet may include a single terrace having any suitable length, which extends around to any suitable portion of the toilet bowl (e.g., only between the jet hole and to a location near the front of the toilet bowl, etc.).

Further, the terrace 22 may extend from the jet hole in either an upward, downward, or level (i.e., horizontal) direction. For example, the terrace 22 may rise in height from the jet hole to a front portion of the toilet bowl 10, and then may decrease in height from the front portion of the bowl 10 to an opposite rear portion of the bowl 10. A width of the terrace 22 may also vary across its length. For example, the width of the terrace may decrease from the jet hole to an end of the terrace. Also, the position of the terrace within the bowl may be configured to control splashing of flush water flowing along the terrace. For example, the terrace may be positioned at a suitable height to prevent flush water from splashing. The terrace 22 may also be canted (i.e., tilted, sloped, etc.) downwards or upwards relative to the curvature of the bowl surface of the toilet bowl 10 in order to control splashing or to control the amount of water that falls off the terrace. For example, the terrace 22 may be configured such that an outer portion of the terrace adjacent the inner wall of the bowl 10 is higher than an inner portion of the terrace so as to direct the flush water down the inner wall into the bowl. It should be understood that a terrace may be configured in any suitable way, and that the lengths, slopes, shapes, and widths of the terraces described herein are not limiting.

Whereas the terrace 22 shown in FIGS. 2-4 is shown as extending around a majority of the toilet bowl 10, a toilet bowl may include a much shorter terrace, according to an exemplary embodiment. Although not shown in the FIGURES, the toilet bowl 10 may include a short terrace, relative to the terrace shown in FIGS. 2-4, that is configured to direct flush water along a specific flow path. For example, the length of such a terrace may not extend all the way to a front portion of the toilet bowl 10. In particular, the length of the terrace may be approximately 5-6 inches long, which may be sufficient to direct the flow path of flush water around the entire toilet bowl 10. Further, beginning from proximately the jet hole, the width of the terrace may gradually decrease. It should be understood that the terrace may be any suitable length in order to provide direction to the flush water flowing from the jet hole, and that the lengths of the terrace disclosed herein are not limiting.

According to another exemplary embodiment, the toilet bowl may omit the terrace and rely on the kinetic energy of the flush water for ensuring that the flush water is carried around the inner surface of the bowl. One example of such a configuration is shown in FIG. 12, where the jet hole is positioned in a similar location as illustrated with respect to the other embodiments described herein. Of course, the size, shape, and position of the jet hole may vary according to other exemplary embodiments, and all such variations are intended to fall within the scope of the present disclosure.

Figure 16A:
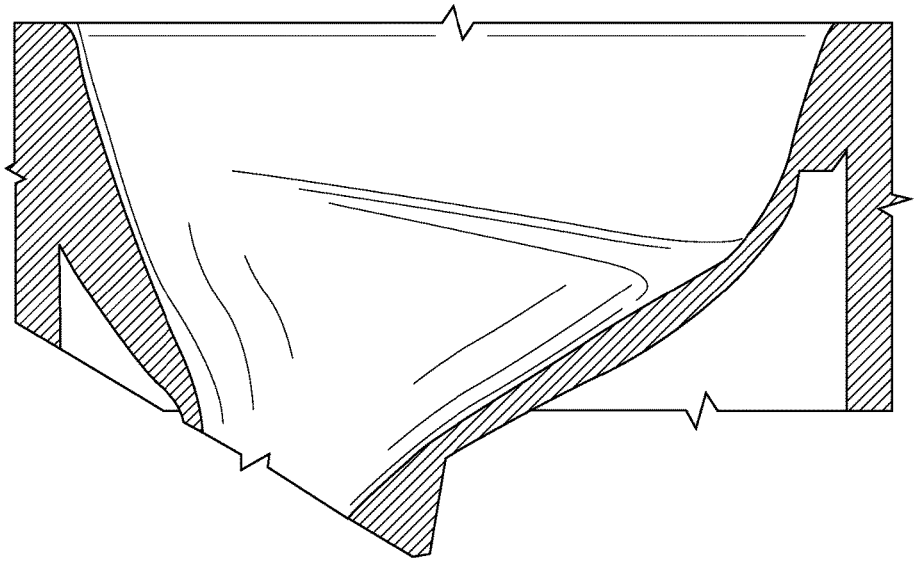
FIG. 16A is a cross-sectional view of a rimless toilet having a short shelf which does not extend to a forward portion of a toilet bowl.
Figure 16B:
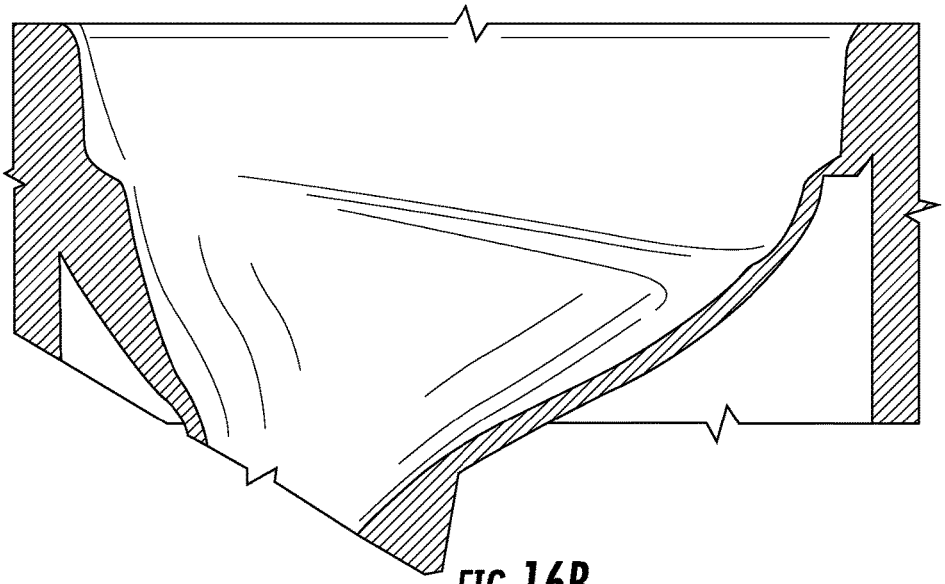
FIG. 16B is a cross-sectional view of a rimless toilet having a shelf extending to a forward portion of the bowl and a rear portion of the bowl, according to an exemplary embodiment.
Figure 16C:
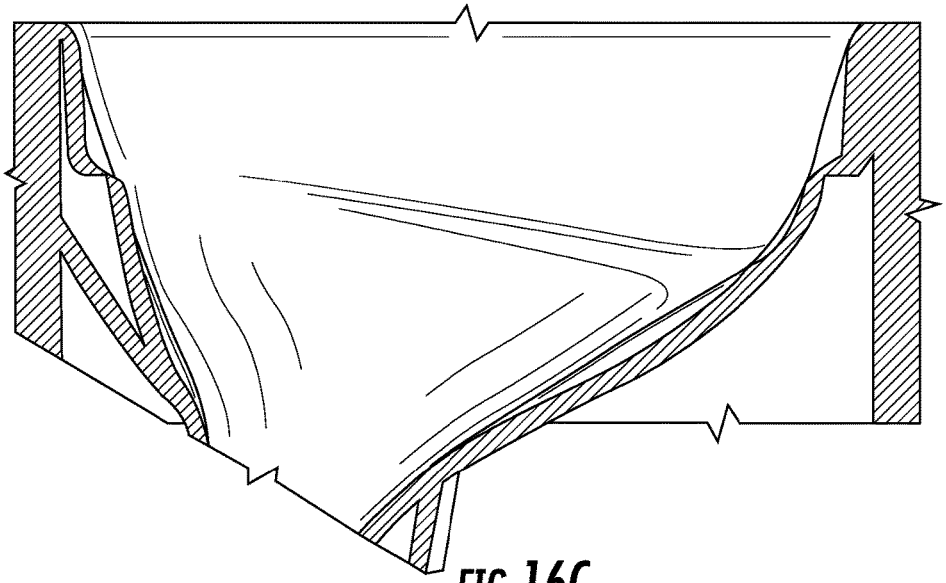
FIG. 16C is a cross-sectional view illustrating the comparison between the rimless toilets shown in FIGS. 16A and 16B.

FIGS. 16A-16C illustrate the differences between a toilet bowl having a relatively long terrace and a bowl having a relatively short terrace which does not extend to a forward position of the bowl (or, alternatively, a bowl without a terrace). In particular, FIG. 16A shows a cross-section of a toilet bowl having a relatively short terrace (or, alternatively, a bowl without a terrace). FIG. 16B shows a toilet bowl having a relatively long terrace that extends at least to a forward position of the bowl. FIG. 16C shows how the toilet bowls of FIGS. 16A-16B compare to each other when the bowl of FIG. 16A is superimposed over the bowl of FIG. 16B. For example, the bowl openings and outlets for both toilet bowls are approximately the same dimensions, but the terrace is "smoothed over" for the toilet bowl having a relatively short terrace (or, alternatively, no terrace).

It was discovered during experimentation that water distribution over a toilet bowl having a smoothed-over terrace (or a relatively short terrace) is not compromised relative to the water distribution of toilet bowls having longer terraces. Also, compared to toilets having relatively long terraces, a toilet having a shorter terrace may advantageously require less material (e.g., vitreous china, porcelain, etc.) to cast the toilet bowl. Also, a toilet having a shorter terrace may be advantageously easier to manufacture because the molds may include features that are less complicated to cast. Thus, toilets having relatively short terraces may be less expensive to manufacture, while at the same time provide performance that is comparable to toilets having longer terraces. Further, reducing the size, length, and/or presence of a terrace may also improve the ease of cleaning of the toilet bowl as a result of less surface area and fewer creases (i.e. inflection points, changes in curvature, etc.). It should be understood that toilet bowls of various heights and lengths may be designed without a terrace.

Further, because of the improved swirl flow of the rim water for the various toilets described herein, lower amounts of rim water may be used to wash the toilet bowl. The improved swirl flow may be due in part to the flush water having a greater kinetic energy in a horizontal portion of the flow. As the horizontal kinetic energy of flush water increases, the capability of the flush water to rinse dirt and debris from the sides of the toilet bowl may increase. As the capability of the flush water to reach greater portions of the toilet bowl increases, less rim water may be needed. Thus, more water may be allowed to go to the sump jet, which may improve the flush performance.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilet as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A toilet, comprising:

a bowl; and a vertically-elongated jet hole disposed within a portion of the bowl near a top of the bowl;

wherein the vertically-elongated jet hole is configured to direct flush water around an inner surface of the bowl to wash the inner surface of the bowl; and wherein the bowl does not include a rim that overhangs any portion of the bowl above the vertically-elongated jet hole.

2. The toilet of claim 1, further comprising a shelf configured to direct water from the jet hole around the bowl.

3. The toilet of claim 2, wherein the shelf is configured such that an outer portion of the shelf adjacent the inner surface is higher than an inner portion of the shelf so as to direct the flush water down the inner surface into the bowl.

4. The toilet of claim 2, wherein a width of the shelf decreases from a first end proximate the jet hole to an opposite second end.

5. The toilet of claim 4, wherein the shelf extends from the first end past a rearmost portion of the bowl.

6. The toilet of claim 1, wherein the vertically-elongated jet hole is located between a rear of the bowl and a side of the bowl approximately 30-60 degrees away from a rearmost portion of the bowl.

7. The toilet of claim 1, wherein the inner surface of the bowl includes a concave portion that transitions to a convex portion.

8. The toilet of claim 1, wherein the toilet is a gravity-fed toilet.

9. The toilet of claim 1, further comprising a sump jet orifice, wherein the ratio of the area of the vertically-elongated jet orifice to the area of the sump jet orifice is between approximately 0.5 and 5.0.

10. The toilet of claim 1, wherein a height of the vertically-elongated jet hole is at least 1⅛ inches.

11. A toilet comprising:

a bowl having a vertically-elongated jet orifice disposed within a portion of the bowl, wherein the vertically elongated jet orifice is configured to introduce flush water into the bowl from an interior water channel through a surface of an inner wall of the bowl, wherein the flush water is directed around the inner wall of the bowl to wash the inner wall; and a shelf for directing the flush water;

wherein the toilet is a gravity-fed toilet that is free of any overhangs or undercuts at any portion of the bowl above the vertically-elongated jet orifice.

12. The toilet of claim 11, wherein the jet hole is positioned near a top of the bowl approximately 30-60 degrees from a rearmost portion of the bowl.

13. The toilet of claim 11, wherein the toilet includes a single jet orifice near the top of the bowl and a sump jet orifice to direct flush water into a sump of the bowl.

14. The toilet of claim 13, wherein the vertically-elongated jet orifice has a first area and the sump jet orifice has a second area, and wherein the ratio of the first area to the second area is between approximately 0.5 to 5.0.

15. The toilet of claim 11, wherein the shelf has a length of less than approximately 6 inches.

16. The toilet of claim 11, wherein a width of the shelf decreases from a first end proximate the vertically-elongated jet orifice to an opposite second end.

17. A toilet comprising:

a tank configured to contain flush water;

a bowl having an opening, an outlet, and a jet hole disposed within a portion of the bowl, wherein the jet hole is in fluid communication with the tank via a water channel;

a valve to control water through the water channel during a flush cycle; and a shelf configured to distribute water from the jet hole around the bowl;

wherein the jet hole is elongated in a vertical direction such that the height of the hole is greater than the width of the hole at its greatest width; and wherein the bowl does not include any overhangs or undercuts at any portion of the bowl above the jet hole.

18. The toilet of claim 17, wherein the jet hole is positioned near a top of the bowl approximately 30-60 degrees away from a rearmost portion of the bowl, and wherein the jet hole is configured to cause the water to swirl around an inner surface of the bowl to clean the inner surface.

19. The toilet of claim 17, wherein the jet hole has a generally polygonal shape.

20. The toilet of claim 17, wherein the shelf is angled downward into the bowl.

* * * * *